US009561874B2

(12) United States Patent
Draier

(10) Patent No.: US 9,561,874 B2
(45) Date of Patent: Feb. 7, 2017

(54) DEVICE FOR FILLING GRANULAR, PULVERULENT AND FREE-FLOWING MATERIALS INTO A CONTAINER MADE OF GEOTEXTILE MATERIAL

(76) Inventor: Roland Draier, Gütersloh (DE)

( * ) Notice: Subject to any disclaimer, the term of this patent is extended or adjusted under 35 U.S.C. 154(b) by 327 days.

(21) Appl. No.: 13/809,647

(22) PCT Filed: Jul. 13, 2011

(86) PCT No.: PCT/EP2011/061961

§ 371 (c)(1),
(2), (4) Date: Jan. 11, 2013

(87) PCT Pub. No.: WO2012/007507

PCT Pub. Date: Jan. 19, 2012

(65) Prior Publication Data

US 2013/0112317 A1 May 9, 2013

(30) Foreign Application Priority Data

Jul. 16, 2010 (DE) ..... 20 2010 008 093 U

(51) Int. Cl.
*B65B 1/04* (2006.01)
*B65B 9/20* (2012.01)

(52) U.S. Cl.
CPC . *B65B 1/04* (2013.01); *B65B 9/20* (2013.01); *B65B 9/2063* (2013.01)

(58) Field of Classification Search
CPC ..... B29C 53/56; B29C 53/58; B29C 53/581; B29C 53/583; B29C 53/68; B29C 53/70; B65B 9/10; B65B 9/20; B65B 9/2063; B65B 1/04; B65H 18/08; B65H 18/085; B65H 18/10; B65H 18/103; B65H 18/106; B65H 18/20; B65H 16/021; B65H 16/023

(Continued)

(56) References Cited

U.S. PATENT DOCUMENTS 1,795,876 A * 3/1931 McCoy ..... 57/15
3,128,216 A * 4/1964 Reed ..... 156/190

(Continued)

FOREIGN PATENT DOCUMENTS

DE 3824757 A1 * 2/1989 ..... B29C 53/66
DE 102006028473 A1 12/2007

(Continued)

OTHER PUBLICATIONS

International Search Report (Feb. 23, 2012) for corresponding International Application PCT/EP2011/061961.

*Primary Examiner* — Timothy L Maust
*Assistant Examiner* — Andrew Stclair
(74) *Attorney, Agent, or Firm* — WRB-IP LLP

(57) ABSTRACT

A device is provided for filling granular, pulverulent and free-flowing materials into a container, preferably a hose- and sack-shaped container, made of geotextile material. The device includes a housing that allows the advancement of the material and in which a conveying device is arranged. On the entry side of the conveying device the material can be filled in and on the exit side thereof a hose made of geotextile material receives the material. The hose can be shaped on the jacket of the housing, and can be unwound as a web from a feeding device that is designed like a roll. Longitudinal sides of the web can be connected to each other by a device in the region of the jacket. The housing includes a tubular body that extends perpendicular to the direction of advance and is arranged vertically, the tubular body interacting with a feeding device for the geotextile material, which rotates about the jacket of the tubular body and is designed as an unrolling device.

8 Claims, 4 Drawing Sheets

(58) Field of Classification Search
USPC ..... 141/10, 114, 314; 53/434, 450–453, 53/550–554; 242/439–439.6
See application file for complete search history.

(56) References Cited

U.S. PATENT DOCUMENTS

| | | | | | |
|---|---|---|---|---|---|
| 3,507,137 | A | * | 4/1970 | Robinson et al. | 72/148 |
| 3,570,749 | A | | 3/1971 | Sato et al. | |
| 3,895,929 | A | * | 7/1975 | Jysky et al. | 55/334 |
| 3,957,098 | A | * | 5/1976 | Hepworth et al. | 383/45 |
| 4,136,501 | A | * | 1/1979 | Connolly | 53/461 |
| 4,174,599 | A | * | 11/1979 | Callet et al. | 53/512 |
| 4,553,374 | A | * | 11/1985 | Lancaster et al. | 53/465 |
| 4,930,292 | A | * | 6/1990 | Focke et al. | 53/588 |
| 5,012,631 | A | * | 5/1991 | Hostetler et al. | 53/588 |
| 5,215,127 | A | * | 6/1993 | Bergeron | 141/10 |
| 5,531,061 | A | * | 7/1996 | Peterson | 53/526 |
| 5,669,732 | A | * | 9/1997 | Truitt | 405/20 |
| 5,699,915 | A | * | 12/1997 | Berger et al. | 206/597 |
| 5,771,665 | A | * | 6/1998 | Nelson et al. | 53/459 |
| 6,085,810 | A | * | 7/2000 | Castillo et al. | 141/391 |
| 6,269,849 | B1 | * | 8/2001 | Fields, Jr. | 141/166 |
| 6,554,935 | B1 | * | 4/2003 | Payne | 156/156 |
| 6,658,825 | B1 | * | 12/2003 | Bliek et al. | 53/522 |
| 6,662,832 | B2 | * | 12/2003 | Baker | 141/234 |
| 7,921,624 | B2 | * | 4/2011 | Ours et al. | 53/399 |
| 8,714,211 | B1 | * | 5/2014 | Schaefer | 141/317 |
| 2006/0151059 | A1 | * | 7/2006 | Ours et al. | 141/314 |
| 2011/0011037 | A1 | * | 1/2011 | Kean | 53/450 |
| 2012/0308311 | A1 | * | 12/2012 | Ross | E02D 31/002 405/302.6 |

FOREIGN PATENT DOCUMENTS

| | | | | | |
|---|---|---|---|---|---|
| WO | 9740978 | A1 | | 11/1997 | |
| WO | WO 2010035295 | A1 | * | 4/2010 | B65B 25/04 |

* cited by examiner

DEVICE FOR FILLING GRANULAR, PULVERULENT AND FREE-FLOWING MATERIALS INTO A CONTAINER MADE OF GEOTEXTILE MATERIAL

BACKGROUND AND SUMMARY

Device for filling of granular, pulverulent and free-flowing materials into a container made of geotextile material.

The invention concerns, according to an aspect thereof, a device for filling of granular, pulverulent and free-flowing materials into a container made of geotextile material, preferably in a hose and sack shaped container, comprising a housing, that allows the advancement of the material and in which a conveying device is arranged, on the entry side of which the material can be filled in and on its exit side a hose made of geotextile material receives the material, and wherein the hose can be shaped on the jacket of the housing, which can be unwound as a web from a feeding device that is designed like a roll, and wherein the longitudinal sides of the web can be connected to each other by means of a device in the region of the jacket.

Hoses made of geotextile material, preferably filled with sand, but also with gravel or broken stone or similar construction materials, can be used in particular to erect ramparts, for example, for protective structures like dikes, noise-insulating walls and the like. The geotextile material has sufficient strength to hold the granular materials in a matrix, while the geotextile material is water-permeable in construction. Thus, tubes made in this way can be used advantageously in dam building, and they can be used also in repair of dams, as well as in their construction. A dam made with the tubes has a good stability, which in particular prevents an undermining or overtopping of the dam.

Thus, a filling unit is known from DE 10 2006 028 473, with which hoses made from geotextile material can be filled. The unit specified in this document comprises a worm conveyor, disposed in a housing, at whose entry side the sand or gravel is introduced, while on the outer circumference of the housing a hose is formed, into which the material is forced into the resulting hose by means of the worm conveyor. One drawback of this type of configuration of a filling unit is considered to be the fact that the unit is very costly in construction, on the one hand, and on the other band the worm conveyor is subjected to great wear. Furthermore, the problem exists, especially in regard to the feeding direction, that the unit has to be pulled, which requires a mechanical infrastructure tailored to the unit, so that a flexible use of the unit is only possible to some extent.

It is desirable to further modify a device for the filling of granular, pulverulent, and free-flowing materials into a container made from geotextile material that is much more simple in its design and that has more flexible application.

PRESENTATION OF THE INVENTION

The device according to an aspect of the invention consists of or comprises a housing, which extends perpendicular to the direction of advance, and advantageously the housing consists of or comprises a vertically arranged tubular body. In this way, the filling of the material into the housing can occur by free fall, so that a spontaneously formed cone of material in the housing brings about the necessary compacting. In order to place the hose sheath about the material that has been formed and compacted, an unrolling device which rotates about the jacket of the tubular body interacts with the housing, being provided with the geotextile material via a feeding device. Thus, on the one hand the device can be manipulated in flexible manner, since it can be suspended from a crane arm or an excavator, and the free-flowing material can be introduced into the upper region of the tubular body by means of a conveyor belt, the tubular body settling toward the bottom of the housing, while at the same time by lifting the device in the feed direction the resulting column of material is sheathed with the geotextile material as it is unrolled.

The device of an aspect of the invention can also handle free-flowing material that is pumped into the tubular body. The geotextile material is water-permeable in construction, so that after the pumping process the water is discharged through the wound enclosing surface and the solids are held back in the wound hose.

Thus, thanks to the design an aspect of the invented device, a filled hose can be prepared on site with the usual available construction equipment.

According to one advantageous embodiment of the invention, the feeding device consists of or comprises a frame outfitted with at least one roller. Preferably three rollers are disposed on the frame. These rollers are mounted in pivot axles in the frame, taking up a slightly slanted position.

The frame itself consists of or comprises two triangular frames arranged one on top of the other, and in the corner regions of the triangular frames are arranged bearing seats for the pivot axles of the rollers. To make possible the slanted position on the rollers, the upper triangular frame is arranged with an offset relative to the lower triangular frame, so that the upper triangular frame body is arranged with an offset by a slight amount relative to the lower triangular frame body. As a further modification of the invention, a cylinder is provided to adjust the slanted position between the upper triangular frame and the lower triangular frame.

To enable the unrolling device to rotate about the housing, a swivel head is secured to the side leg on the upper triangular frame, lying against the tubular body. The unrolled geotextile material is adjusted on the surface of the tubular body by means of pressing rollers, which are provided on the side legs of upper and lower triangular frame. In this way, a folding or curling of the unrolled material on the jacket of the tubular body is likewise prevented. The overlap formed by the unrolling of the material is advantageously connected to a connecting device provided on the swivel head.

For the connection being made, one can advantageously use an automatic stapler. The use of a connection mechanism to apply a bead of adhesive in the overlap region is also possible, producing an endless gluing in the overlap region of the unrolled webs. The adhesive used can consist of comprise hot melt glue, which is applied by an applicator nozzle.

As a further modification of the tubular body, it consists of or comprises two coaxially nested, conically configured pipe elements, the conicity of the externally arranged pipe element decreasing toward the exit end, while the conicity of the internally arranged pipe element increases toward the outside. Thanks to this configuration, the geomaterial cloth being unwound on the envelope surface of the tubular body on the one hand easily detaches from the housing jacket by lifting of the device, due to the advancement, and on the other hand forms a compacted column with the filling of the inner pipe element, and the column as a result of the lifting of the device by the jib arm is caught or contained by the connected geomaterial cloth at the lower housing wall. The interior pipe element with its specific conicity, increasing toward the exit end, has the particular advantage of behaving like a baking mold, wherein the centrally formed and migrating cone of free-flowing material is introduced in the interior pipe, and as the device is lifted the compacted shaped cylindrical column of free-flowing material is formed.

BRIEF DESCRIPTION OF THE DRAWINGS

A sample embodiment of the invention is shown schematically in the drawings and shall be described more closely hereafter. There is shown.

DETAILED DESCRIPTION

Figure 1:
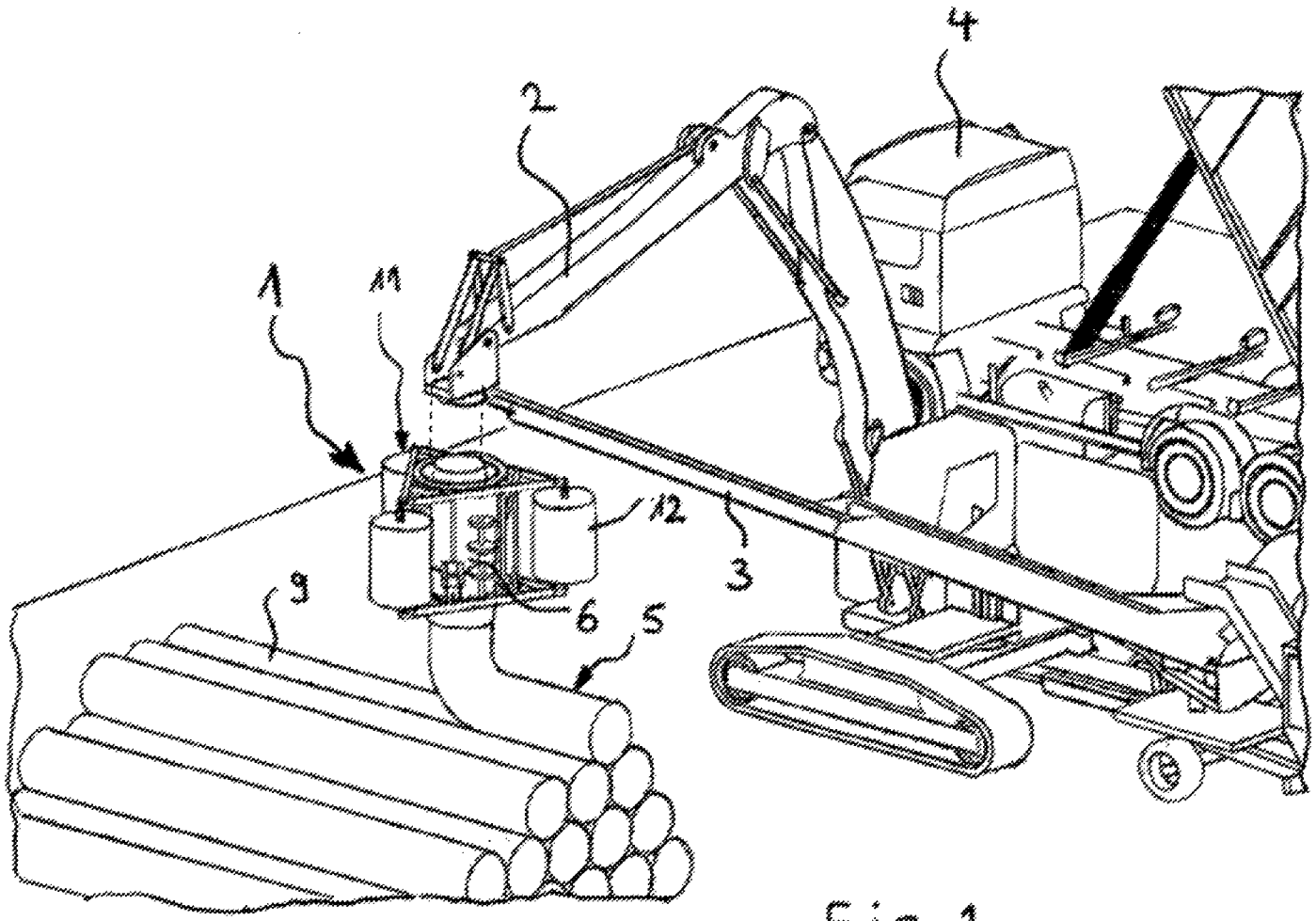
FIG. 1, a system drawing in which the device according to the invention is incorporated, FIG. 2, a perspective representation of the device.
Figure 2:
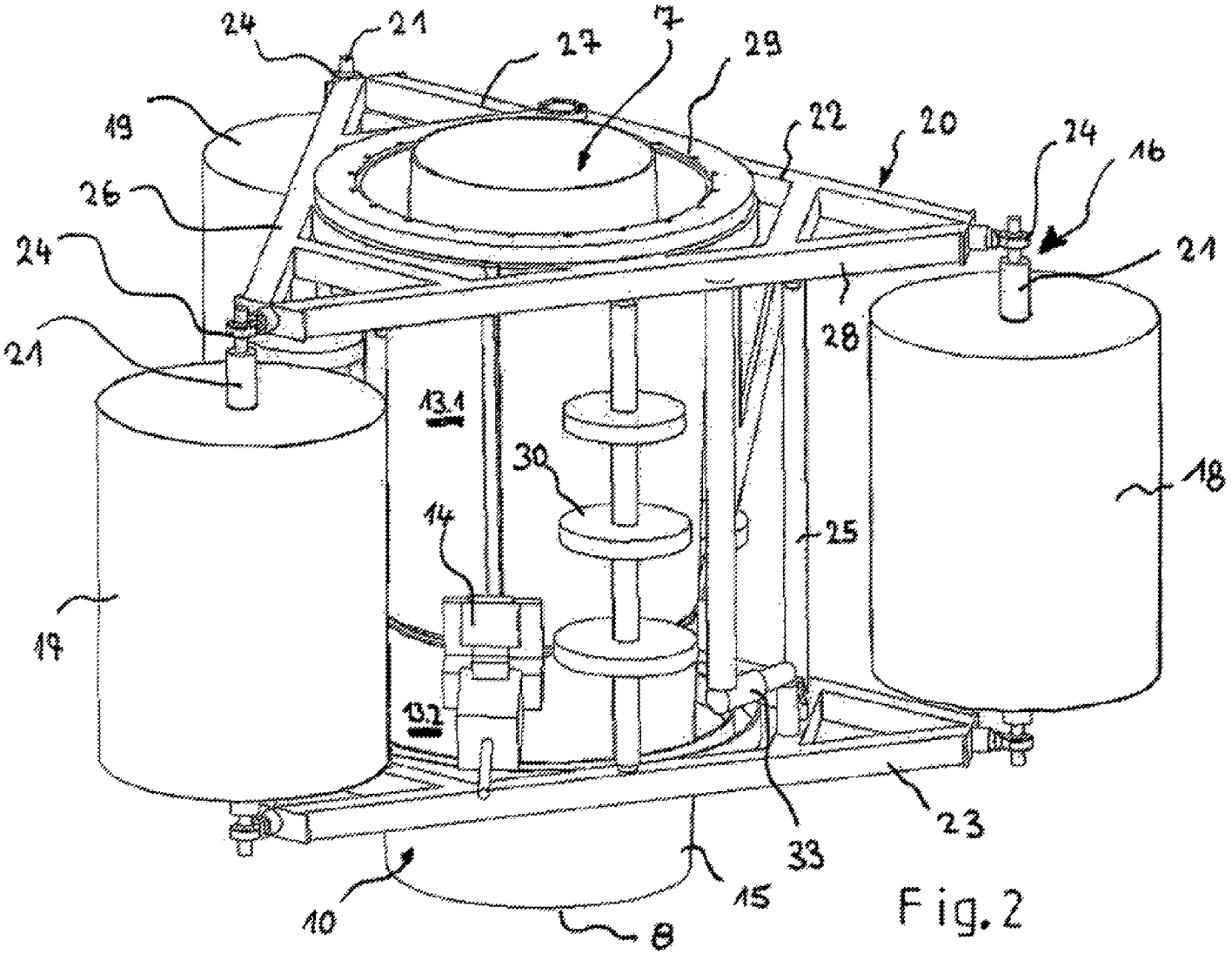
Figure 3:
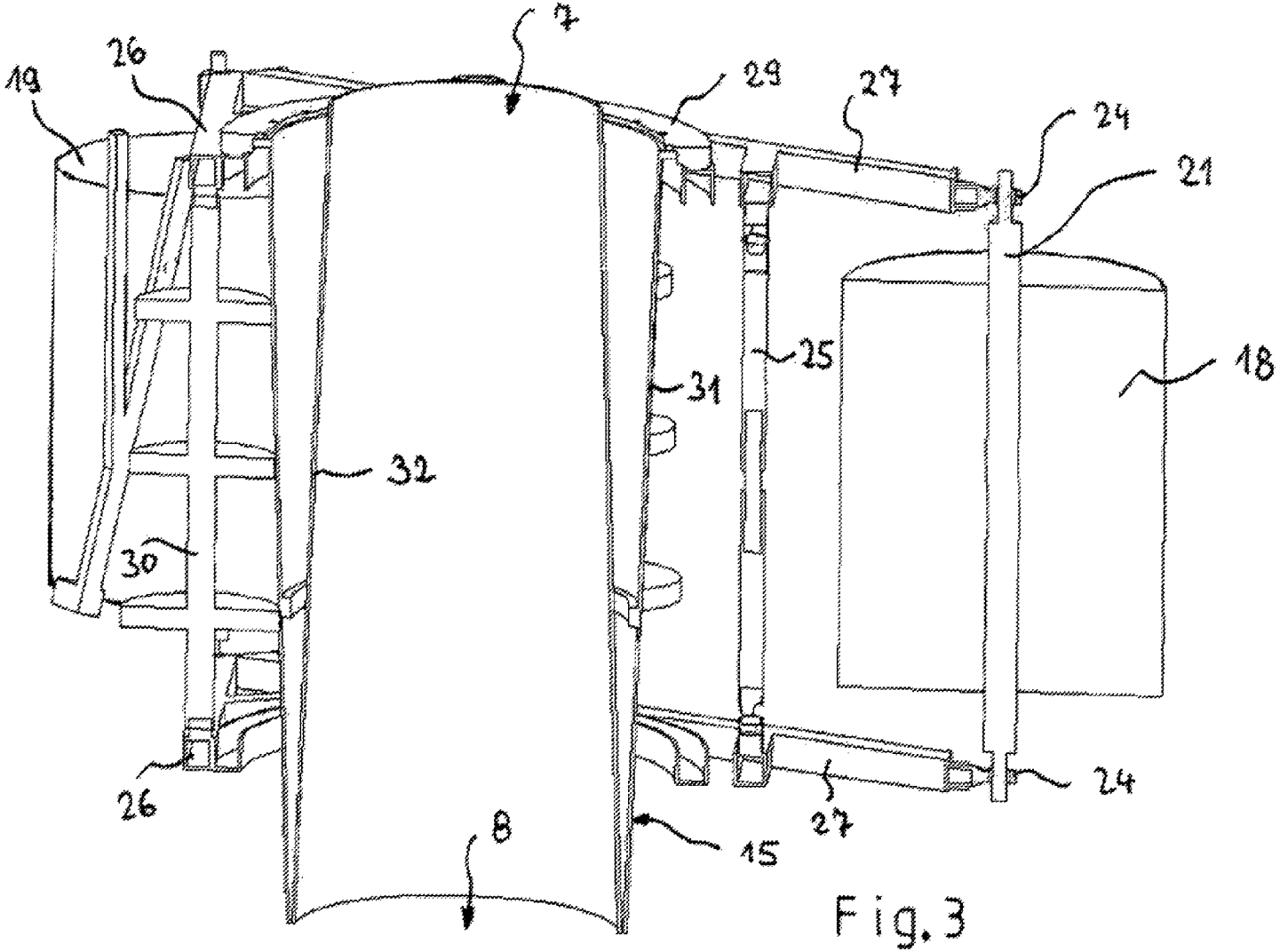
FIG. 3, a sectional representation of the device according to FIG. 2.
Figure 4:
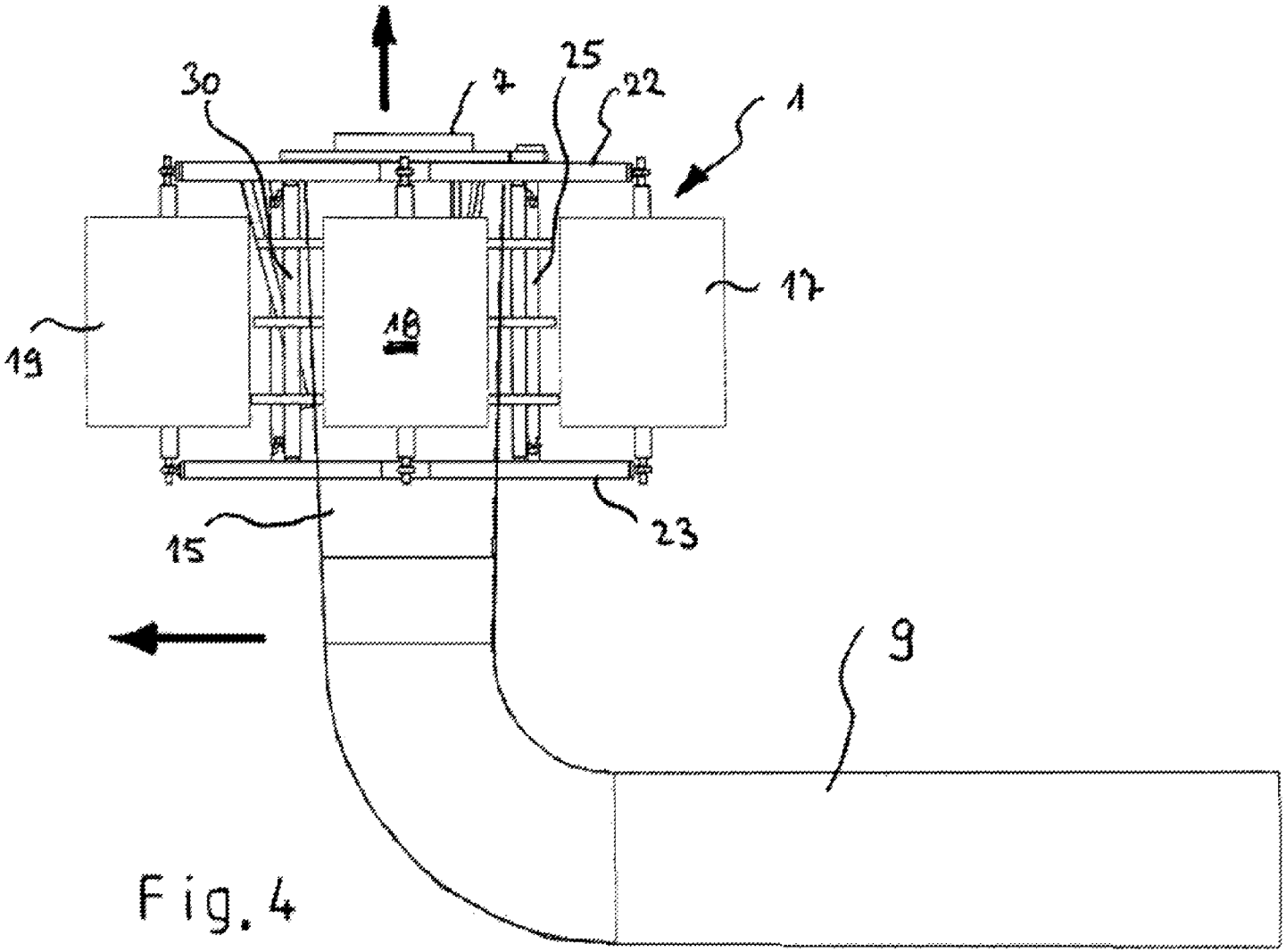
FIG. 4, a side view of the device with a filled hose.

FIG. 1 shows in a system view the incorporation of a device 1 as is represented more closely in FIGS. 2, 3 and 4. As can be seen from FIG. 1, a caterpillar vehicle is disposed there, on whose arm 2 the device 1 is arranged. For the filling of the device 1 there is provided a conveyor belt 3, whose discharge delivers the material into the upper opening of the device 1. Also seen in FIG. 1 is a delivery truck 4, which delivers the material to a hopper, from which the material is then taken by further conveyor belts to the conveyor belt 3. Beneath the device 1, the containers 5 made of geotextile material are then deposited, here preferably in the form of tubes, for the building of a dam.

Looking at FIG. 2, 3 and 4 taken together, one notices that the device 1 for the filling of granular, pulverulent, and free-flowing materials consists of or comprises a container 5 made from geotextile material, here preferably a hose shaped container, as is shown in particular in FIG. 4. The device 1 comprises a housing 6 that allows the advancement of the material in the horizontal arrow direction, on the entry side 7 of which the material can be filled in, while on its exit side 8 a hose 9 made of the geotextile material receives the material. The hose 9 can be shaped on the jacket 10 of the housing 6, wherein the geotextile material can be unwound as a web from a roll 11 of a feeding device 12. In the region of the material 10, the longitudinal sides of the web 13.1 and 13.2 can be connected to each other by means of a connection mechanism 14.

As can be seen from FIGS. 2 and 4 taken together, the housing 6 here consists of or comprises a vertically arranged tubular body 15, being supported perpendicular to the direction of advancement, as can be seen in FIG. 1. The tubular body 15 as such interacts here with a feeding device 12, configured as an unrolling device 16 and rotating about the jacket of the tubular body 15. Now, it is obvious that when the unrolling device 16 is rotating about the housing 6, the geotextile material is correspondingly wound by the feeding device 12 about the housing 6 configured as a tubular body 15. One notices from FIG. 2 that the feeding device 12 consists of or comprises a frame 20 outfitted with three rollers 17, 18 and 19. The pivot axles 21 of the rollers 17, 18 and 19 are arranged at a slant in the frame 20. As can be seen from the perspective view of FIG. 2, the frame 20 consists of or comprises two triangular frames 22 and 23, arranged one above the other, while bearing seats 24 for the pivot axles 21 of the rollers 17, 18 and 19 are arranged in the corner regions of the triangular frames 22 and 23. The upper rotary frame 22 is offset from the rotary frame 23, in order to form the slanted position for the pivot axles 21 of the rollers 17, 18 and 19. To adjust this slanted position, an adjusting element 33 adjusting the slanted position is arranged between the upper triangular frame 22 and the lower triangular frame 23. Thus, if the adjusting element 33 is extended, the triangular frames 22 and 23 are staggered apart, while the retracting of the adjusting element 33 brings the triangular frames 22 and 23 to their starting position, i.e., aligned with each other. The adjusting element 33 can have pneumatic, mechanical or electrical operation.

Deflection rollers 25 are arranged between the triangular frames 22 and 23, each roller 17, 18 and 19 being, coordinated with one deflection roller 25. The individual deflection roller 25 ensures a more secure wrinkle-free unwinding process for the particular cloth web 13.1 and 13.2.

Further, one can see from FIG. 2 that a swivel head 29 is attached or enclosed on the side legs 26, 27, 28 at the upper triangular frame 22, resting against the tubular body 15. Pressure rollers 30 are provided on the side legs 26, 27 and 28, both on the upper and the lower triangular frame 22, 23, which in particular press the unwound material cloth against the housing jacket, so that no folds are formed and it lies neatly against the tubular body 15. To join the overlapping region of the unwound cloth webs, the connection mechanism 14 is provided on the swivel head 29, which joins the seam here. One can preferably use a staple gun for this, which shoots U-shaped staples into the seam region, so that a firm joint is produced between the longitudinal sides of the webs, here in the unrolled situation.

According to an especially advantageous embodiment of the invention, shown in the sectional view of FIG. 3, one notices that the tubular body 5 consists of or comprises two coaxially nested, conically configured pipe elements 31 and 32. One also notices that the conicity of the outer pipe element 31 tapers toward the exit end 8, whereas the conicity of the inner pipe element 32 increases toward the exit end 8. Thanks to this configuration, on the one hand the unwound cloth that lies in tubular form about the jacket of the housing 6 is more easily separated from the housing jacket when the jib arm 2 lifts the device 1. The inner pipe element 32, whose conicity extends opposite the conicity of the first pipe element 31, has the advantage that a good compacting flow is achieved in the pipe element 32, and it works here like a baking mold.

According to FIG. 4, now, it is understood that when free-flowing material is filled into the device 1, a cone of material is formed in the pipe element 32, and by lifting the device 1 along the arrow direction of the unrolling device 16 and then winding the geotextile material about the housing 6, the free-flowing material is initially shaped as a vertical column, and is enclosed or taken up in the wound hose 9. Once the filled hose 9 has reached a particular vertical extent, the hose 9 is then placed horizontally in situ in the direction of advancement.

01 device
02 jib arm
03 conveyor belt
04 truck
05 container
06 housing
07 entry end
08 exit end
09 hose
10 jacket
11 roller
12 feeding device
13.1 13.2 web

14 connection mechanism
15 tubular body
16 unrolling device
17 roller
18 roller
19 roller
20 frame
21 pivot axles
22 triangular frame
23 triangular frame
24 bearing seats
25 deflection rollers
26 side leg
27 side leg
28 side leg
29 swivel head
30 pressing rollers
31 pipe element, outer
32 pipe element, inner
33 adjusting element

The invention claimed is:

1. Device for the filling of granular, pulverulent, and free-flowing material into a container made from geotextile material, comprising a movable arm, a housing movable by the arm to allow advancement of the material in a direction of advance and relative to which a conveying device for conveying the material to the housing, is adapted to he arranged, the material being tillable in the housing on an entry side of the housing and the housing, having an exit side at which a hose made of geotextile material receives the material, and wherein the hose is shaped on a jacket of a tubular body of the housing, a feeding device, the hose being adapted to be unwound as a web from the feeding device, and a connection mechanism for connecting longitudinal sides of the web to each other to form a seam, wherein the tubular body extends perpendicular to the direction of advance of the material and is arranged vertically, the tubular body interacting with the feeding device, the feeding device being adapted to rotate about the jacket and comprising an unrolling device, wherein the feeding device comprises as frame outfitted with at least one roller on which a roll of the web for forming the hose is arranged to be mounted, the frame comprising two triangular frames arranged one on top of the other, bearing seats for pivot axles of the at least one roller being arranged in corner regions of the triangular frames.

2. Device according o claim 1, wherein the frame is outfitted with three rollers.

3. Device according to claim 2, wherein the pivot axles of the rollers are disposed in the frame in a slanted position.

4. Device according to claim 3, wherein an upper triangular frame of the two triangular frames is adapted to be arranged with an offset relative to a lower triangular frame of the two triangular frames.

5. Device according to claim 4, wherein a cylinder is provided to adjust a slant between the upper triangular frame and the lower triangular frame.

6. Device according to claim 5, wherein a swivel head is secured to legs of the upper triangular frame, the swivel head lying against the tubular body.

7. Device according to claim 6, wherein pressing rollers are provided on legs of the upper triangular frame and lower triangular frame.

8. Device according to claim 7, wherein the connection mechanism is provided on the swivel head.

* * * * *